US009296956B2

(12) United States Patent
Li et al.

(10) Patent No.: US 9,296,956 B2
(45) **Date of Patent: *Mar. 29, 2016**

(54) METHOD FOR REDUCING MERCAPTANS IN HYDROCARBONS

(75) Inventors: Lin Li, Richmond, CA (US); Zunqing He, San Rafael, CA (US); Zhen Zhou, Emeryville, CA (US); King T. Ng, Lafayette, CA (US); Paul E. Hajdu, Benicia, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 227 days.

This patent is subject to a terminal disclaimer.

(21) Appl. No.: 13/281,114

(22) Filed: Oct. 25, 2011

(65) Prior Publication Data

US 2012/0103872 A1 May 3, 2012

Related U.S. Application Data

(63) Continuation-in-part of application No. 12/914,275, filed on Oct. 28, 2010.

(51) Int. Cl.
*C10G 27/02* (2006.01)
*C10G 17/07* (2006.01)
(Continued)

(52) U.S. Cl.
CPC ..... *C10G 17/07* (2013.01); *C10G 19/02* (2013.01); *C10G 53/10* (2013.01); *C10G 53/12* (2013.01); *C10G 2300/1033* (2013.01); *C10G 2300/202* (2013.01)

(58) Field of Classification Search
CPC ..... C10G 27/00; C10G 27/02; C10G 27/04; C10G 17/00; C10G 17/02; C10G 17/04; C10G 17/07; C10G 19/00; C10G 19/02; C10G 5300/02; C10G 53/10; C10G 53/12; C10G 53/14; C10G 2300/202; C10G 2300/1033
USPC ..... 208/208 R, 262.1, 189, 190, 203, 204, 208/219, 220, 226, 227, 231
See application file for complete search history.

(56) References Cited

U.S. PATENT DOCUMENTS 1,277,329 A 8/1918 McAfee
1,435,824 A 11/1922 Dunstan
(Continued)

FOREIGN PATENT DOCUMENTS

JP 09-001191 A 7/1997

OTHER PUBLICATIONS

Cedeño-Caero et al, Oxidative desulfurization of dibenzothiophene compounds with titania based catalysts , Aug. 2011, Catalysis Today, 172 (1), p. 189-194.
(Continued)

*Primary Examiner* — Prem C Singh
*Assistant Examiner* — Brandi M Doyle
(74) *Attorney, Agent, or Firm* — Parul Anderson; Gregory L. Porter, Andrews Kurth LLP

(57) ABSTRACT

A method for reducing mercaptan concentration in a crude oil is disclosed. The method comprises contacting the crude with a treating solution comprising a hypochlorite solution, whereby the mercaptan sulfur is oxidized and converted to at least one sulfur oxoacid or salt thereof, yielding a treated crude oil having less than 50 ppm mercaptan sulfur and residual organic chloride. The treated crude oil containing residual organic chloride is brought in contact with a caustic solution at a molar ratio of caustic to chloride of 0.1:1 to 50:1, generating an upgraded crude oil with less than 10 ppm organic chloride. In one embodiment, the spent treating solution is recycled to form a regenerated hypochlorite stream for use in the treatment solution.

19 Claims, 1 Drawing Sheet

(51) Int. Cl.

| | |
|---|---|
| ***C10G 19/02*** | (2006.01) |
| ***C10G 53/10*** | (2006.01) |
| ***C10G 53/12*** | (2006.01) |

(56) References Cited

U.S. PATENT DOCUMENTS

| | | | | |
|---|---|---|---|---|
| 1,491,916 | A | 4/1924 | Mann et al. | |
| 1,710,200 | A | 4/1929 | Black et al. | |
| 1,927,068 | A | 9/1933 | McClaughry et al. | |
| 1,941,475 | A | 1/1934 | Jaeger et al. | |
| 2,022,942 | A | 12/1935 | Schulze et al. | |
| 2,028,998 | A | 1/1936 | Schulze et al. | |
| 2,488,855 | A | 11/1949 | Denton | |
| 2,527,176 | A | 10/1950 | Cohen | |
| 2,550,668 | A | 5/1951 | Brandon et al. | |
| 2,567,399 | A | 9/1951 | Proell | |
| 2,602,062 | A | 7/1952 | De Groote | |
| 2,605,230 | A | 7/1952 | De Groote | |
| 2,605,231 | A | 7/1952 | De Groote | |
| 2,605,232 | A | 7/1952 | De Groote | |
| 2,605,233 | A | 7/1952 | De Groote | |
| 2,626,905 | A | 1/1953 | De Groote | |
| 2,626,929 | A | 1/1953 | De Groote | |
| 2,721,166 | A | 10/1955 | Earhart | |
| 2,763,593 | A | 9/1956 | Leesemann | |
| 2,813,834 | A | 11/1957 | Verberg | |
| 2,862,877 | A | 12/1958 | Pieters et al. | |
| 2,903,422 | A * | 9/1959 | Beest et al. | 208/190 |
| 2,915,461 | A | 12/1959 | Davies et al. | |
| 3,039,957 | A | 6/1962 | Robbins et al. | |
| 3,632,515 | A | 1/1972 | Sharman | |
| 3,634,287 | A | 1/1972 | Woo | |
| 3,639,282 | A | 2/1972 | Sharman | |
| 3,716,620 | A | 2/1973 | Deschamps et al. | |
| 3,754,377 | A | 8/1973 | Clonts | |
| 3,758,404 | A | 9/1973 | Clonts | |
| 3,977,829 | A | 8/1976 | Clonts | |
| 4,120,779 | A * | 10/1978 | Baird et al. | 208/108 |
| 4,675,100 | A | 6/1987 | Maple et al. | |
| 4,746,494 | A | 5/1988 | Maple et al. | |
| 4,753,722 | A | 6/1988 | Le et al. | |
| 4,786,405 | A | 11/1988 | Kutty et al. | |
| 4,816,139 | A | 3/1989 | Keyworth | |
| 5,122,351 | A | 6/1992 | Hardison | |
| 5,360,632 | A | 11/1994 | Johnson et al. | |
| 5,651,896 | A | 7/1997 | Nagl | |
| 5,698,172 | A | 12/1997 | McManus et al. | |
| 5,705,074 | A | 1/1998 | Brient | |
| 5,730,860 | A | 3/1998 | Irvine | |
| 6,406,616 | B1 * | 6/2002 | Rappas et al. | 208/240 |
| 6,406,749 | B1 | 6/2002 | Symons | |
| 6,641,714 | B2 | 11/2003 | Walsh | |
| 6,805,787 | B2 * | 10/2004 | Bess et al. | 205/500 |
| 6,860,999 | B2 | 3/2005 | Greaney et al. | |
| 6,960,291 | B2 | 11/2005 | Greaney et al. | |
| 7,077,884 | B2 | 7/2006 | Davis et al. | |
| 7,214,290 | B2 | 5/2007 | Duesel, Jr. et al. | |
| 7,279,148 | B1 | 10/2007 | Nagl et al. | |
| 7,344,682 | B1 | 3/2008 | Nagl et al. | |
| 7,550,033 | B2 | 6/2009 | Beuke et al. | |
| 7,731,838 | B2 | 6/2010 | McConnachie et al. | |
| 7,744,749 | B2 | 6/2010 | Martinie et al. | |
| 7,875,185 | B2 | 1/2011 | Zhang | |
| 7,914,669 | B2 | 3/2011 | Martinie et al. | |
| 7,955,419 | B2 | 6/2011 | Casella | |
| 8,048,175 | B2 | 11/2011 | Yang et al. | |
| 2002/0038776 | A1 | 4/2002 | Walsh | |
| 2002/0043501 | A1 | 4/2002 | Irvine | |
| 2003/0052046 | A1 | 3/2003 | Greaney et al. | |
| 2003/0085181 | A1 | 5/2003 | Greaney et al. | |
| 2003/0094414 | A1 | 5/2003 | Greaney et al. | |
| 2003/0136263 | A1 | 7/2003 | Beuke et al. | |
| 2004/0040671 | A1 | 3/2004 | Duesel, Jr. et al. | |
| 2006/0151359 | A1 | 7/2006 | Ellis et al. | |
| 2006/0254930 | A1 | 11/2006 | Martinie et al. | |
| 2007/0051667 | A1 | 3/2007 | Martinie et al. | |
| 2007/0227950 | A1 * | 10/2007 | Martinie et al. | 208/217 |
| 2007/0251650 | A1 | 11/2007 | Duesel, Jr. et al. | |
| 2008/0035530 | A1 * | 2/2008 | Greaney et al. | 208/254 R |
| 2008/0067109 | A1 | 3/2008 | Greaney et al. | |
| 2008/0230445 | A1 | 9/2008 | O'Brien et al. | |
| 2008/0296204 | A1 | 12/2008 | Venkateshan | |
| 2008/0308503 | A1 | 12/2008 | Zhang et al. | |
| 2009/0065398 | A1 | 3/2009 | McConnachie et al. | |
| 2009/0065434 | A1 | 3/2009 | Zhang | |
| 2009/0255849 | A1 | 10/2009 | Yang et al. | |
| 2010/0078358 | A1 | 4/2010 | Tullos et al. | |
| 2010/0320124 | A1 | 12/2010 | Zhang et al. | |
| 2011/0024680 | A1 | 2/2011 | Via et al. | |
| 2011/0068046 | A1 | 3/2011 | Tullos et al. | |
| 2011/0073526 | A1 | 3/2011 | Haitko et al. | |
| 2011/0113680 | A1 | 5/2011 | O'Brien et al. | |
| 2011/0127194 | A1 | 6/2011 | Zhang et al. | |
| 2011/0142747 | A1 | 6/2011 | Nagl et al. | |
| 2011/0163008 | A1 | 7/2011 | Zhang et al. | |
| 2011/0203972 | A1 | 8/2011 | Gargano et al. | |

OTHER PUBLICATIONS

Chunshan Song et al New design approaches to ultra-clean diesel fuels by deep desulfurization and deep dearomatization , Mar. 2003, Applied Catalysis B: Environmental, 41 (1-2), p. 207-238.

PCT International Search Report and Written Opinion, International Application No. PCT/US2011/057722, dated Jun. 29, 2012.

* cited by examiner

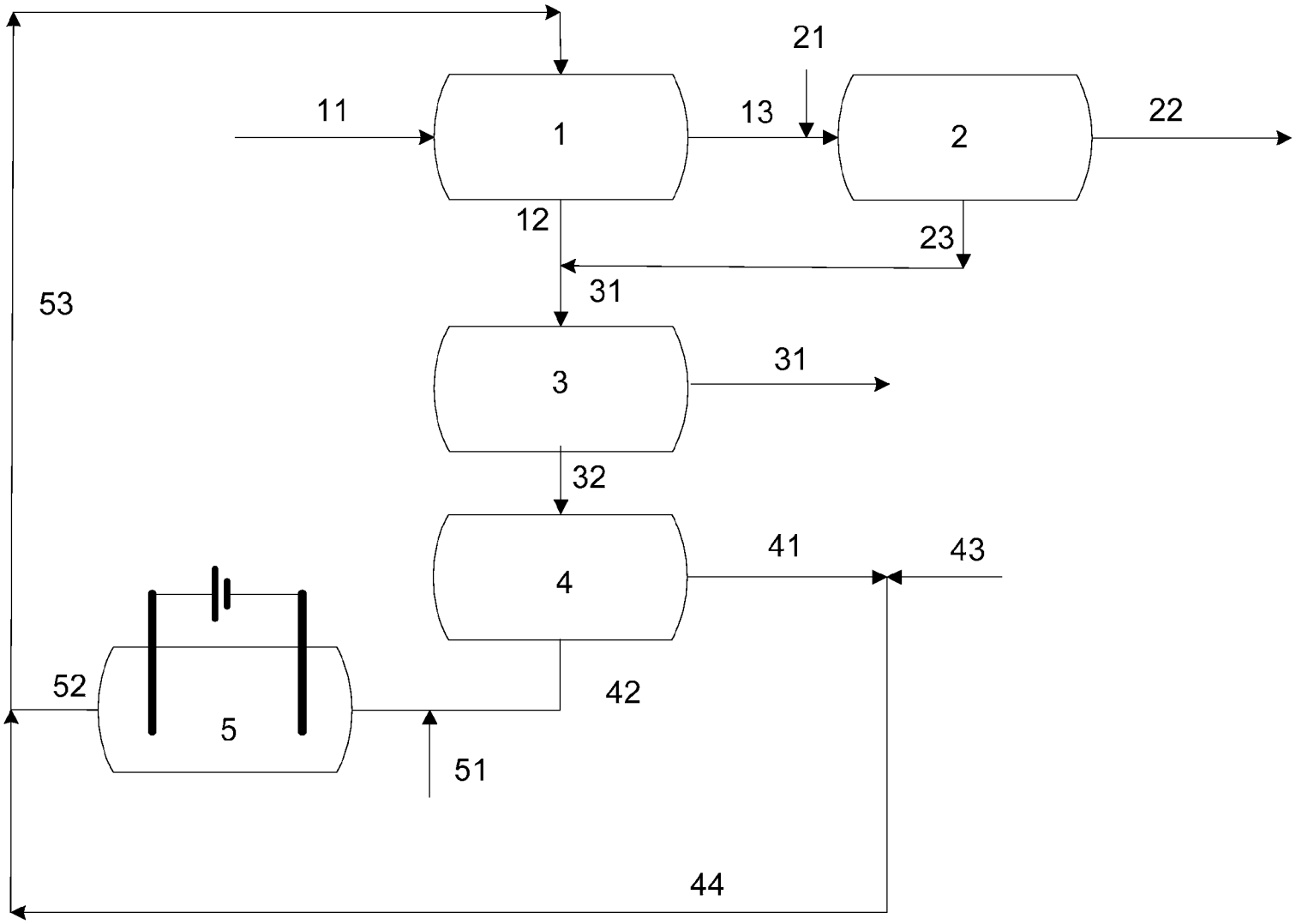
1
2
3
4
5
11
12
13
21
22
23
31
31
32
41
42
43
44
51
52
53

METHOD FOR REDUCING MERCAPTANS IN HYDROCARBONS

CROSS-REFERENCE TO RELATED APPLICATIONS

This application is a continuation-in-part (CIP) of U.S. patent application Ser. No. 12/914,275 with a filing date of Oct. 28, 2010. This application claims priority to and benefits from the foregoing, the disclosure of which is incorporated herein by reference.

TECHNICAL FIELD

The invention relates generally to methods for reducing mercaptan concentration in liquid hydrocarbons.

BACKGROUND

Some hydrocarbons, such as crude oil and jet fuel, contain significant amounts of mercaptans which may have an impact on the value of these hydrocarbon streams. As a result, such hydrocarbon streams are usually sold at a discount in the market or have to be upgraded to meet product spec. Thus, reducing the mercaptan content could substantially improve both the marketability and the value of such hydrocarbons.

Various additives have been employed for the removal of sulfur compounds from hydrocarbon streams ("sweetening" process). Conventional methods in the prior art for removing mercaptans from hydrocarbons typically involve "sweetening," wherein mercaptans are oxidized to form disulfides. Light mercaptans ($C_1$-$C_4$) may be removed in an aqueous wash in this process but removal of heavy mercaptans ($C_{4+}$) is less effective due to the poor water solubility of heavy mercaptans. Disulfides which are derived from heavy mercaptans may decompose back to mercaptans at high temperatures, for example, during the distillation process. U.S. Pat. No. 7,914,669 discloses a process to reduce sulfur from liquid hydrocarbon with an agent select from hypochlorites, cyanurates and alkali metal and alkaline earth metal hydroxide.

After treatment with an oxidant such as hypochlorite as disclosed in the prior art, the treated crude product may not be suitable for downstream processing with a high inorganic content in the treated crude. Additionally, transportation of fresh bulk chlorine to distant sites for crude treatment (as well as the removal of waste chlorine after treatment) is a major safety concern since the transport of chlorine gas under high pressure can be very hazardous. The transportation of commercial hypochlorite, which is predominantly water, is very expensive due to stringent regulations to prevent accidental releases.

There is still a need for an improved and effective process for the removal of sulfur containing compounds such as mercaptans from crudes. There is further a need for an integrated system for the removal of mercaptans with minimal chlorite to waste treatment.

SUMMARY OF THE INVENTION

In one aspect, the invention relates to a method for reducing mercaptan concentration in a liquid hydrocarbon, comprising: contacting a mercaptan-rich liquid hydrocarbon having a first concentration of mercaptan sulfur with a composition comprising an oxidizing agent and water wherein the molar ratio of the oxidizing agent to mercaptan sulfur in the mercaptan-rich liquid hydrocarbon is from 3:1 to 10:1; and separating the water from the liquid hydrocarbon to yield a mercaptan-depleted liquid hydrocarbon having a second concentration of mercaptan sulfur, the second concentration being less than the first concentration; wherein a major amount of mercaptan compounds in the mercaptan-rich liquid hydrocarbon are converted to at least one sulfur oxoacid or salt having the formula $[RSO_x]_nY$ wherein R is a hydrocarbyl group; x is an integer from 1 to 3; n is 1 or 2; and Y is hydrogen, an alkaline metal, or alkaline earth metal.

In another aspect, the invention relates to a method for treating a crude oil containing mercaptans. The method comprises contacting a crude oil feed with a treatment solution comprising a hypochlorite wherein the molar ratio of hypochlorite to mercaptan sulfur in the liquid hydrocarbon ranges from 1:1 to 10:1, whereby the hypochlorite oxidizes the mercaptans generating a treated crude oil having a reduced concentration of mercaptans of less than 50 ppm and a first concentration of chloride and a spent treatment solution containing at least a sulfur oxoacid or salt thereof, having the formula $[RSO_x]_nY$, wherein R is a hydrocarbyl group; x is an integer from 1 to 3; n is 1 or 2; and Y is hydrogen, an alkaline metal, or alkaline earth metal; recovering the spent treatment solution and the treated crude oil; contacting the treated crude oil with a caustic solution at a molar ratio of caustic to chloride of 0.1:1 to 50:1, generating a spent alkaline solution and an upgraded crude oil having a reduced concentration of mercaptan and a reduced concentration of chloride; and recovering the spent alkaline solution and the upgraded crude oil having a reduced concentration of mercaptan and a reduced concentration of organic chloride of less than 10 ppm.

In yet another aspect, the invention relates to a closed-loop process to reduce mercaptan sulfur in a crude oil feed. The process comprises: combining a sodium hypochlorite solution with a least a base to form a treatment solution having a pre-select pH; contacting the crude oil feed with the treatment solution comprising the sodium hypochlorite at a pre-select pH under intimate contact conditions sufficient for the hypochlorite to oxidize the mercaptans generating a treated crude oil having a reduced concentration of mercaptans of less than 50 ppm and a first concentration of chloride and a spent treatment solution; separating the spent treatment solution and the treated crude oil to recover the spent treatment solution and the treated crude oil as separate streams; contacting the treated crude oil stream with a caustic solution under mixing conditions sufficient to generate a spent alkaline solution and an upgraded crude oil having less than 50 pp, mercaptan and less than 10 ppm organic chloride; separating the spent alkaline solution and the upgraded crude oil; treating the spent treatment solution to generate a brine solution comprising at least 99 wt. % as sodium chloride in solution; and regenerating the brine solution to form a hypochlorite stream for use in the treatment solution.

BRIEF DESCRIPTION OF THE DRAWINGS

FIG. 1 provides an overview of an embodiment of a process for removing mercaptan sulfur from a crude oil, wherein the spent treatment solution is recycled.

DETAILED DESCRIPTION

The following terms will be used throughout the specification and will have the following meanings unless otherwise indicated.

"Liquid hydrocarbon" refers to all types of hydrocarbon fluids including but not limited to oils obtained from wells, shale, rock and/or sand among others, oil field condensates (e.g., natural gas liquid, etc.), residual oil, petroleum distillates (e.g., gasoline, jet fuel, kerosene, diesel, aromatics, etc.), paraffinic solvents (e.g., pentane, heptane, etc.), renewable fuels such as biodiesel, and mixtures thereof. Liquid hydrocarbon may contain oxygenated compounds, such as alcohols, esters, glycols, ethers, and mixtures thereof. The term "crude" or "crude oil" may be used interchangeably with "liquid hydrocarbon." The term "crude" or "crude blend" is used interchangeably and each is intended to include both a single crude and blends of crudes.

"Jet fuel" refers to hydrocarbons having a boiling range between 280° F. and 572° F. (138° C. and 300° C.).

"Mercaptan" refers to compounds of the general formula R—SH wherein "R" means a hydrocarbyl group and "SH" means a mercaptan group. It is understood that hydrogen sulfide ($H_2S$) may also be removed (treated) along with mercaptan in the process and system of the invention.

"Sweeten" or "sweetening" refers to the process step or steps to remove sulfur and sulfur compounds including mercaptans from crude oil.

"Hydrocarbyl" refers to hydrocarbyl radicals containing 1 to 48 carbon atoms including branched or unbranched, cyclic or acyclic, saturated or unsaturated species, such as alkyl groups, alkenyl groups, or aryl groups.

"Mercaptan-rich liquid hydrocarbon" refers to a liquid hydrocarbon having a mercaptan sulfur content of at least 200 ppm.

"ppm" means parts per million.

The invention effectively reduces the level of mercaptan sulfur in a liquid hydrocarbon with the use of a hypochlorite solution as an oxidant. In one embodiment, the process is a closed-loop process wherein spent hypochlorite is recycled and regenerated for the oxidizing reaction.

Liquid Hydrocarbon for Treatment:

The concentration of mercaptan sulfur in a liquid hydrocarbon is dependent on the source. In one embodiment, the liquid hydrocarbon contains at least 200 ppm mercaptan sulfur; in a second embodiment, at least 300 ppm mercaptan sulfur; in a third embodiment, at least 400 ppm mercaptan sulfur; in a fourth embodiment, at least 500 ppm mercaptan sulfur; in a fifth embodiment, at least 600 ppm mercaptan sulfur; in a sixth embodiment, no more than 3000 ppm mercaptan sulfur.

Additive(s) for Mercaptan Reduction:

The additive composition for the removal of mercaptans comprises at least a hypochlorite salt, which is soluble in water or in a water and low molecular weight alkanol mixture. Typical low molecular weight alkanols include methanol and ethanol. In one embodiment, the additive is employed in a molar ratio of 1:1 to 12:1 hypochlorite ($ClO^-$) to mercaptan sulfur (RSH) in the liquid hydrocarbon to be treated. In a second embodiment, from 2:1 to 10:1. In a third embodiment, from 3:1 to 6:1.

Upon contact with the hypochlorite additive, a major amount of mercaptan compounds in the mercaptan-rich liquid hydrocarbon are oxidized and converted. In one embodiment, the oxidized mercaptan is in the form of sulfur oxoacid or salt thereof, having the formula $[RSO_x]_nY$, wherein R is a hydrocarbyl group; x is an integer from 1 to 3; n is 1 or 2; and Y is hydrogen, an alkaline metal, or alkaline earth metal. Sulfur oxoacid (and salt) is highly water soluble and therefore easily removed from the hydrocarbon stream. The term "major amount" is understood to mean greater than 50 percent by weight of mercaptan compounds in the mercaptan-rich liquid hydrocarbon.

In one embodiment, the hypochlorite additive is an alkali or alkaline earth metal hypochlorite salt, e.g., sodium hypochlorite, potassium hypochlorite, calcium hypochlorite, and magnesium hypochlorite. In one embodiment, the additive is sodium hypochlorite. Aqueous sodium hypochlorite solutions are widely available in varying concentration ranges, from 1 wt. % to saturation. In one embodiment, the concentration ranges from 1-15 wt. %.

In one embodiment, the pH of the additive composition may be adjusted to a pre-select pH prior to being brought into contact with the liquid hydrocarbon for treatment by adding a suitable base selected from alkali metal hydroxides, alkaline earth metal hydroxides, and mixtures thereof. The pre-select pH ranges from 7 to 14 in one embodiment, from 8-12 in a second embodiment; from 8-10 in a third embodiment.

Sweetening Process:

In one embodiment, a mercaptan-rich liquid hydrocarbon having a first concentration of mercaptan sulfur is "sweetened" upon contact with the additive composition by means known in the art, followed by separating the water from the liquid hydrocarbon to yield a mercaptan-depleted liquid hydrocarbon having a second concentration of mercaptan sulfur, the second concentration being less than the first concentration. The contact can be from 20° C. to 300° C.; in a second embodiment, from 20° C. to 100° C.: in a third embodiment, at room temperature. The amount of the hypochlorite composition to the mercaptan-rich crude ranges from 5:95 to 95:5 volumetric ratio in one embodiment; from 1:5 to 5:1 in a second embodiment; from 1:4 to 3:1 in a third embodiment. The volumetric ratio of hypochlorite to crude varies depending on a number of factors, including the concentration of hypochlorite solution and the amount/type of the sulfur compounds in the crude.

In one embodiment, at least 60 percent by weight of the mercaptan compounds in the mercaptan-rich liquid hydrocarbon are converted to the at least one sulfur oxoacid or salt thereof; in a another embodiment, at least 70 percent by weight of the mercaptan compounds in the mercaptan-rich liquid hydrocarbon are converted to the at least one sulfur oxoacid or salt thereof; in yet another embodiment, at least 80 percent by weight of the mercaptan compounds in the mercaptan-rich liquid hydrocarbon are converted to the at least one sulfur oxoacid or salt thereof. In one embodiment, the treated crude contains less than 50 ppm mercaptan sulfur; in a second embodiment, less than 40 ppm mercaptan sulfur; in a third embodiment, less than 30 ppm mercaptan sulfur; in a fourth embodiment, less than 20 ppm mercaptan sulfur; in a fifth embodiment, less than 10 ppm mercaptan sulfur; in a sixth embodiment, less than 5 ppm mercaptan sulfur; in a seventh embodiment, less than 1 ppm mercaptan sulfur.

The contact is for a sufficient time such that a major amount of mercaptan compounds in the mercaptan-rich liquid hydrocarbon are converted to at least one sulfur oxoacid or salt. In one embodiment, the contact time is at least 30 seconds; in a second embodiment, at least one minute; in a third embodiment, at least five minutes; in a fourth embodiment, at least one hour; in a fifth embodiment, at least two hours; in a sixth embodiment, less than 24 hours.

In one embodiment, vigorous mixing is desired to minimize the formation of disulfides (RSSR) and maximize the conversion of mercaptans into the sulfonic and sulfonic acid forms ($RSO_xH$). In one embodiment, the hypochlorite composition can be introduced continuously or intermittently into operating pipelines containing the crude. Alternatively, batch introduction can be used for offline pipelines or equipment. In yet another embodiment, crude oil is injected on a continuous or intermittent basis into the hypochlorite solution for maximum contact.

After mixing for a selected period of time, the mixture is then allowed to settle so that two distinct layers may form. The lower layer containing spent hypochlorite solution and oxidized sulfur compounds can be separated from the crude oil in a phase separation device known in the art, resulting in a mercaptan-depleted ("treated") crude with a substantially lower concentration of mercaptan sulfur. Suitable phase separation devices include, but are not limited to, cyclone devices, electrostatic coalescent devices, gravitational oil-water separators, and centrifugal separators.

In one embodiment before sweetening with hypochlorite, the mercaptan-rich crude oil is optionally brought into contact with a caustic solution at a crude to caustic solution volume ratio ranging from 5:1 to 1:10, and caustic concentration ranging from 1-5 wt. %. In another embodiment, the process further includes a second and subsequent mercaptan extraction step with the hypochlorite solution, or other oxidants, to further reduce mercaptan content as well as other sulfur compounds that are difficult to oxidize. In one embodiment, a final extraction step with ionic liquid may be included. In another embodiment, substitution of the hypochlorite solution with ionic liquid for one of the extraction steps may be conducted. In yet another embodiment, the mercaptan-rich crude oil is optionally brought into contact with an oxygen containing gas stream, such as air, before contacting the hypochlorite solution, to accelerate the oxidation reaction. The contacting between the crude oil and the hypochlorite solution can be either via non-dispersive or dispersive methods. The non-dispersive method can be via either packed inert particle beds or fiber film contactors. The dispersive contacting method can be via any of mixing valves, static mixers and mixing tanks or vessels.

In one embodiment, the treatment step is carried out in a unit operation with two separate zones, a contact zone and a separation zone. The contact zone is for the contact between the hypochlorite and the crude oil, which can be in any form of packed tower, bubble tray, stirred mixing tank, fiber contacting, rotating disc contactor or other contacting devices known in the art. In one embodiment, the liquid-liquid contact is via fiber contacting, which is also called mass transfer contacting, wherein large surface areas are provided for mass transfer in a non-dispersive manner as described in U.S. Pat. Nos. 3,997,829; 3,992,156; and 4,753,722. The separation zone can be at least a separation device selected from any of settling tanks or drums, coalescers, electrostatic precipitators, and other similar devices.

In one embodiment, the treatment is via an integrated unit, e.g., a single vessel having a contact zone for mercaptan-rich crude to be in intimate contact with the hypochlorite solution (and/or optional additives and alternative treatment additives), and a settling zone for the separation of the treated crude from the spent hypochlorite solution. Hypochlorite solution can be mixed with the crude oil prior to entering the contact zone, or injected as a separate stream into the contacting zone. The flow of the hypochlorite solution and the crude oil in the unit can be counter-current or con-current.

In another embodiment, the treatment is via a single tower with a top section for the oxidizing with hypochlorite and a bottom section for the separation of the treated crude from the spent hypochlorite solution. In one embodiment, the top section comprises at least a contactor characterized by large surface areas, e.g., a plurality of fibers or bundles of fibers, allowing mass transfer in a non-dispersive manner. The fibers for use in the contactors are constructed from materials consisting of but not limited to metals, glass, polymers, graphite, and carbon, which allow for the wetting of the fibers and which do not contaminate the process or be quickly corroded in the process. The fibers can be porous or non-porous, or a mixture of both.

In one embodiment, the oxidizing section contains at least two contactors comprising fibers in series. The fibers in each contactor are wetted by the hypochlorite solution to form a thin film on the surface of fibers, and present a large surface area to the crude oil to be treated by the oxidizing of mercaptans by the hypochlorite solution. The admixture of the treated crude oil and spent hypochlorite solution exits the bottom of the first contactor and flows into the next contactor in series, then exiting the bottom contactor and is directed to a bottom separation section. In one embodiment with two contactors in series, additional fresh hypochlorite solution is provided to the second contactor for the additional treatment of the crude. In yet another embodiment, spent hypochlorite solution from the separation zone is recycled back to the oxidizing section for treatment of the crude.

In the separation section, the treated crude is allowed to separate from the spent hypochlorite via gravity settling. In one embodiment, the bottom section also comprises fibers to aid with the separation, wherein the mixture of treated crude oil and spent hypochlorite solution flows through the fibers to form two distinct liquid layers, an upper layer of treated crude and a lower layer of spent hypochlorite solution.

In yet another embodiment, the sweetening step is carried out in an integrated unit having multiple sections, e.g., an extractor section for converting mercaptans to $RSO_3H$ upon contact with hypochlorite; a pre-mixing section for adjusting the hypochlorite to a pre-select pH with the addition with an alkali such as caustic, with the pre-mixing section in direction communication with the extractor section; and a coalescer/separation section in communication with the extractor section for the separation of treated crude from the spent hypochlorite.

In one embodiment, an interface control structure is employed for sensing the interface level between the treated crude and the spent hypochlorite solution. The interface control structure is adjusted to optimally alter the vertical height of the interface level within the equipment, and/or the flows of the various inlet and outlet streams to the equipment for optimal mercaptan removal.

Further details regarding the description of the different integrated units and the interface control structure are described in US Patent Publication Nos. US20100200477, US20100320124, US20110163008, US20100122950, and US20110142747; and U.S. Pat. Nos. 7,326,333 and 7,381,309, the relevant disclosures are included herein by reference.

Desalting Process:

The treated crude, after the sweetening step, has a residual organic halide impurity content, typically from about 40 to 4000 ppm. The presence of organic halides in such treated products may be undesirable. In one embodiment, the treated crude undergoes a desalting step, e.g., being brought in contact with an aqueous caustic solution under conditions to generate an upgraded crude with a reduced halide concentration. In one embodiment, the aqueous caustic solution is selected from alkali and alkaline earth metal hydroxide solutions, and mixtures thereof. Examples include lithium hydroxide, sodium hydroxide, sodium carbonate, potassium hydroxide, calcium hydroxide, and magnesium hydroxide solutions. In one embodiment, the aqueous caustic solution is a sodium hydroxide solution. In another embodiment, the concentration of caustic ranges from 0.001 N to 10 N. In a yet another embodiment, the caustic concentration ranges from 0.5 N to 5N. In a fourth embodiment, the caustic stream comprises aqueous sodium hydroxide at a concentration ranging from about 2 to about 30 mol %.

In one embodiment, the molar ratio of caustic to halogen-containing oxidizing agent, e.g., chloride, is in the range of 0.1:1 to 50:1. In one embodiment, the amount of aqueous caustic solution to the mercaptan-depleted liquid hydrocarbon is from 5:95 to 95:5 volumetric from which halide is removed. The upgraded crude with a reduced halide concentration contains less than 10 ppm organic chloride in one embodiment; less than 5 ppm in a second embodiment; less than 2 ppm in a third embodiment; and less than 1 ppm in a fifth embodiment. In one embodiment, the upgraded crude may be further processed by hydrotreating, for example.

The mercaptan-depleted crude is contacted with an aqueous caustic solution by means known in the art. Methods may be conducted as batch, semi-continuous or continuous processes (as in the treatment with hypochlorite solution). In one embodiment, the contact is from 20° C. to 300° C.; in a second embodiment, from 25° C. to 200° C.; in a third embodiment, from 30° C. to 150° C.; in a fourth embodiment, from 70° C. to 100° C. Contact may be done with vigorous mixing. In one embodiment, the contact time is at least one minute; in another embodiment, at least five minutes; in yet another embodiment, at least one hour; in still yet another embodiment, at least two hours; in one embodiment, less than 24 hours.

In one embodiment, the aqueous caustic solution further comprises chemical desalters/demulsifiers known in the art. In one embodiment, a low molecular weight alkanol is employed as a co-solvent. The low molecular weight alkanol may have straight or branched chain alkyl groups containing 1 to 4 carbon atoms. Examples of suitable alkanols include methanol, ethanol, n-propanol, isopropanol, n-butanol, isobutanol and tert-butanol and mixtures thereof. Typically, the low molecular weight alkanol is ethanol. In one embodiment, the amount of lower alkanol is from 1-49 percent by weight based on the total weight of the solution; in another embodiment, from 5-25 percent by weight based on the total weight of the solution. In one embodiment, water soluble demulsifiers including but not limited to silicone polyethers, sulphonates, polyglycol ethers and mixtures thereof are employed in the range of 1 to 500 ppm.

In one embodiment, the aqueous caustic solution further comprises a phase transfer catalyst. Examples of suitable phase transfer catalysts include, but are not limited to, quaternary ammonium salts, phosphonium salts and pyridinium salts. If used, the phase transfer catalyst may be present in an amount from 0.001 to 0.5 mole equivalents of caustic agent. In one embodiment, the phase transfer catalyst is a quaternary salt. In one embodiment, the phase transfer catalyst is cetyltrimethylammonium chloride.

In one embodiment, after caustic treatment, the mercaptan-depleted upgraded crude is recovered resulting in a mercaptan-depleted liquid hydrocarbon with a reduced halide concentration. Any means of separating the aqueous caustic solution from the mercaptan-depleted upgraded crude may be used. Examples include decantation, gravity separation, settler based on gravity, extractor, membrane separator, fibrous coalescer as disclosed in U.S. Pat. Nos. 4,640,781 and 5,017,294, and other devices that are known in the art, the relevant disclosures are included herein by reference.

In one embodiment, recovered or spent caustic solution can be routed and combined with spent chlorite solution for subsequent recycled/regeneration generating hypochlorite as feed for the removal of mercaptans. In another embodiment, spent caustic solution is treated via commercially treatment processes to remove undesirable impurities such as sodium sulfide, sodium mercaptide, etc., which can cause high COD and BOD in the waste water treatment plant. In another embodiment, the spent caustic solution is treated to remove residual sulfur compounds prior to recycling according to US Patent Publication No. 20090065434, the relevant disclosures are included herein by reference. In yet another embodiment, the spent caustic solution after treatment is routed to the crude unit or sour water stripper.

In one embodiment, sufficient hypochlorite is recycled/regenerated so that fresh hypochlorite is not needed. In one embodiment, a small amount of hypochlorite may be needed for start-up or as back-up for electrolyzer. In one embodiment, a make-up brine solution is needed to account for losses of brine solution in the system. In one embodiment, this stream accounts for less than 30% of the brine solution needed to generate the hypochlorite for mercaptan removal. In another embodiment, the make-up brine accounts for 5 to 50% of the total brine solution needed to generate the hypochlorite needed for mercaptan removal.

The caustic treatment can be accomplished by any liquid-liquid mixing device, such as packed tower, bubble tray, stirred vessel, fiber contacting, rotating disc contactor, plug flow reactor, etc. In one embodiment, the caustic treatment is performed using equipment substantially the same as for the sweetening process, e.g., a vessel with multiple zones, or a vessel comprising at least a contactor comprising substantially continuous elongated fibers, wherein the fibers are wetted by the caustic solution and present a large surface area to the crude to be desalted. In one embodiment, two or more stages of contacting with an aqueous treatment solution may be adopted to achieve a greater extent of treating efficiency. In yet another embodiment, contactors employing fibers are employed for the phase separation of the spent caustic and the mercaptan-depleted upgraded crude product.

Further details regarding the equipment that can be employed in the desalting of the treated crude are described in US Patent Publication Nos. US20100200477, US20100320124, US20110163008, US20100122950, and US20110142747; and U.S. Pat. Nos. 7,326,333 and 7,381,309, the relevant disclosures are included herein by reference.

Regeneration/Recycling of Spent Hypochlorite Solution:

In one embodiment, spent hypochlorite solution recovered from the sweetening step contains unexpended hypochlorite, sodium chloride NaCl, various products of the reaction treatment including sulfoxides and sulfonate species formed from mercaptan oxidation as well as other impurities. In one embodiment with the addition of a base to control the pH of the sweetening process, the spent solution further includes caustic soda. In one embodiment of the inventive closed-loop process, as much NaCl and water are recovered from the spent treatment solution as possible. In this process step, sulfoxides species, sulfonate species and other non-chloride impurities (collectively, "impurities") are extracted (removed) from the spent treatment solution for the brine solution to meet the impurity specification of the electrolyzer unit for use in regenerating hypochlorite. In one embodiment, at least 95% of the impurities are removed. In another embodiment, at least 99% of the impurities are removed. In one embodiment after the extraction, a brine solution containing less than 0.5 wt. % in impurities is recycled to an electrolyzer for NaClO regeneration.

In one embodiment, impurities are removed using carbon adsorption and/or a water softener unit, e.g., a ion exchange unit employing an anion exchange resin. In another embodiment, cross-flow microfiltration and/or nanofiltration equipment is used separately or in combination with carbon adsorption/carbon filtration for the removal of impurities from the brine solution.

In one embodiment, recovered brine solution is regenerated to generate hypochlorite for use in the treatment solution. In one embodiment, the brine solution undergoes electrolyzing to generate sodium hypochlorite according to equation: $NaCl+H_2O+2e=NaOCl+H_2$. The system in one embodiment comprises an electrolyzer assembly having at least an electrolyzer cell. Details regarding the description of equipment and the electrolyzing step to generate hypochlorite are described in U.S. Pat. Nos. 6,235,167, 6,805,787, and 7,931,795, the relevant disclosures are included herein by reference. The regenerated hypochlorite is routed to the sweetening unit as a feed stream for use in the removal of mercaptans.

In one embodiment prior to electrolyzing, the brine solution is first concentrated for optimal performance in the electrolyzer with maximum efficiency. The removal of water is done via means known in the art, for the brine solution to meet the specification of the electrolyzer. At least 20% of the water is removed in a reverse osmosis (RO) step in one embodiment; at least 50% in a second embodiment; and at least 90% in a third embodiment.

In one embodiment of the hypochlorite recycling process, a system with multiple modules is employed. The system includes: a) a brine softener unit with chelating ion exchange resins for the removal of impurities from the spent hypochlorite generating a brine solution; b) an electrolyzer unit for the production of chlorine gas and a sodium hydroxide co-product from the brine solution; and c) a hypochlorite conversion unit where elemental chlorine gas reacts with sodium hydroxide solution to produce sodium hypochlorite at the desired concentration. In one embodiment, the system further includes a RO unit for the concentration of the brine solution.

Reference will be made to the FIGURE with block diagrams schematically illustrating different embodiments of a closed-loop process/system for the removal of mercaptans, with minimal loss of hypochlorite salt.

In the FIGURE, mercaptan-rich crude 11 is brought into contact with sodium hypochlorite solution 53 in integrated unit 1 for the treatment of the crude with hypochlorite solution and the separation of spent hypochlorite 12 and the treated oil product 13. The oil product 13 is further treated in unit 2 with water or caustic stream 21, so that the product will meet spec for sale or transportation downstream. Unit 2 can be a similar or different from unit 1 in terms of design. In one embodiment, unit 2 is also an integrated unit including a desalter/coalescer, reducing water and inorganic salt content of the treated product, generating a final product oil 22 which can be sent to storage, and spent caustic stream 23 for recycle/re-use.

In one embodiment, the spent hypochlorite stream 12 is combined with the spent water treatment/caustic stream 23 into a combined stream 31. This stream contains sodium chloride, sulfonate species formed from mercaptan oxidation by hypochlorite, as well as other impurities. The spent stream 31 is purified in filtration unit 3 to remove sulfonate species and other impurities. The purified stream 32 is sent to RO unit 4 to be concentrated, generating a fresh water stream 41 and a concentrated brine solution 42 for the electrolyzer unit 5. To compensate for sodium chloride loss in the system, a make-up brine stream 51 is provided to maintain an adequate hypochlorite to mercaptan ratio for the sweetening reaction. Sufficient amount of water 43 is provided to the closed loop and combined with fresh water stream 41, generating enough water to dilute the hypochlorite stream 52 to the desired concentration, constituting hypochlorite solution 53 feed to the system.

EXAMPLES

The following examples are given to illustrate the present invention. It should be understood, however, that the invention is not to be limited to the specific conditions or details described in these examples. Mercaptan sulfur concentration was determined by UOP Method 163-67. Mercaptan sulfur concentration is represented as RSH, RSH refers to mercaptans where R is a light hydrocarbon radical, e.g., methyl or ethyl.

Examples 1-5

A high mercaptan sulfur crude blend (RSH=400 ppm) was treated with an aqueous sodium hypochlorite solution for several minutes with vigorous stirring. The layers were allowed to separate and the treated crude oil was collected. The results are set forth in Table 1. As shown, the mercaptan sulfur content of crude oils is effectively reduced.

TABLE 1

| | NaClO/ RSH mole ratio | NaClO Concentration (wt. %) | Temperature (° C.) | Reaction Time (min) | Total RSH in treated crude (ppm) |
|---|---|---|---|---|---|
| Ex. 1 | 3 | 2 | 23 | 2 | <1 |
| Ex. 2 | 6 | 2 | 23 | 2 | <1 |
| Ex. 3 | 6 | 1 | 23 | 5 | <1 |
| Ex. 4 | 6 | 1 | 70 | 5 | <1 |
| Ex. 5 | 6 | 1 | 70 | 10 | <1 |

Examples 6-9

A light jet fuel (boiling point range=350-450° F.) having RSH of 644 ppm and a heavy jet fuel (boiling point range=450-550° F.) having RSH of 408 ppm were each treated with aqueous sodium hypochlorite solutions for 5 minutes at room temperature with vigorous stirring. The layers were allowed to separate and the treated jet fuel was collected. The sulfur content in the treated oil and in the aqueous layer may be analyzed to determine the extent of conversion of mercaptan sulfur to sulfur oxoacids or salts thereof in the aqueous phase. The results are in Table 2.

TABLE 2

| | Description | NaClO concentration wt. % | NaClO/RSH mole ratio | RSH content after Oxidation (ppm) |
|---|---|---|---|---|
| Ex. 6 | Light Jet Fuel | 1 | 6 | <1 |
| Ex. 7 | Light Jet Fuel | 5 | 6 | <1 |
| Ex. 8 | Heavy Jet Fuel | 1 | 6 | <1 |
| Ex. 9 | Heavy Jet Fuel | 5 | 6 | <1 |

Example 10

A high mercaptan sulfur crude blend (RSH=644 ppm) was treated with a 1% aqueous sodium hypochlorite solution for several minutes at room temperature with vigorous stirring. The layers were allowed to separate and were collected. The total sulfur concentrations of the feed and the treated oil were determined by X-ray fluorescence. The total sulfur concentration in the aqueous was determined by ICP. The results are set forth in Table 3 as an average of five runs, showing 80% reduction of mercaptan sulfur.

TABLE 3

| | |
|---|---|
| Total sulfur in feed | 0.24 g |
| Total mercaptan sulfur in feed | 0.026 g |
| Total sulfur in treated oil | 0.214 g |
| Total sulfur in water phase | 0.0207 g |
| Total sulfur recovered | 0.23 g |
| Overall sulfur recovery rate | 97% |
| Sulfur in water as % of mercaptan sulfur in feed | 80% |

Examples 11-12

A high mercaptan sulfur crude blend (RSH=644 ppm) was treated with an aqueous sodium hypochlorite solution with vigorous stirring. The layers were allowed to separate and the aqueous layer was collected. Phenol was added into the aqueous phase to reduce sodium hypochlorite left in water solution. The aqueous layer was then evaporated at 80° C. under vacuum. The solids were collected and dried at room temperature under vacuum for three days. The relative amounts of sulfur oxoacids, or salts thereof, in the aqueous layer were determined by X-ray photoelectron spectroscopy (XPS). The results are set forth in Table 4, showing over 89 wt. % of the sulfur species in the aqueous phase are sulfur oxoacids having the formula $[RSO_3]_nY$.

Comparative Example A

A halide-containing liquid hydrocarbon was prepared by treating a high mercaptan sulfur crude oil blend with a 1% aqueous sodium hypochlorite solution (6:1 NaClO:RSH molar ratio) for 5 minutes at room temperature with vigorous stirring. The layers were allowed to separate. The crude oil treated with the halide-containing oxidizing agent was collected and then washed several times with water. The organic chloride content in the washed oil was determined according to ASTM D4929.

TABLE 4

| | Reaction Time (min) | NaClO/RSH mole ratio | $[RSO_3]_nY$ Content After Oxidation (wt. %) |
|---|---|---|---|
| Ex. 11 | 0.5 | 3:1 | >89 |
| Ex. 12 | 5 | 6:1 | >90 |

Examples 13-16

A halide-containing liquid hydrocarbon was prepared by treating a high mercaptan sulfur crude oil blend with a 1% aqueous sodium hypochlorite solution (6:1 NaClO:RSH molar ratio) for 5 minutes at room temperature with vigorous stirring. The layers were allowed to separate. The crude oil treated with the halide-containing oxidizing agent was collected and then washed with an aqueous caustic solution. The organic chloride content in the washed oil was determined according to ASTM D4929. The chloride reduction results are set forth in Table 5, showing that aqueous caustic solutions are effective in reducing the organic chloride content of a crude oil treated with the halide-containing oxidizing agent using the disclosed method.

TABLE 5

| | Washing Conditions | Organic Chloride Content (ppm) |
|---|---|---|
| Comp. Ex. A | Water, 25° C., 5 min. | 71 |
| Ex. 13 | 1N NaOH, 25° C., 0.5 min. | 22 |
| Ex. 14 | 1N NaOH, 20° C., 5 min. | 16 |
| Ex. 15 | 1N NaOH/EtOH, 40° C., 30 min. | 11 |
| Ex. 16 | 1N NaOH, 90° C., 60 min. | <1 |

Example 17-21

Model samples were prepared adding a sufficient amount of thiophenol in toluene for a sulfur concentration of 600 ppm. The mixing was carried out in two modes: A) NaClO was stirred mixed in toluene solution at room temperature for _minutes; or B) toluene was injected into the NaClO solution while it was being stirred mixed.

After mixing in either mode (A) or (B), the layers were allowed to separate and the aqueous layer was collected. Phenol was added into the aqueous phase to reduce sodium hypochlorite left in water solution. The aqueous layer was then evaporated at 80° C. under vacuum. The solids were collected and dried at room temperature under vacuum for three days. The sulfur distribution in the aqueous layer were calculated based on GC (gas chromatography) as well as ICP analyses (inductively coupled plasma). The results are set forth in Table 6, showing that RSSR formation can be significantly reduced by improving oil-aqueous contact and optimizing NaClO concentration. The aqueous S calculated from sulfur GC matches the ICP data, showing that the majority of oxidized S species can be removed into the aqueous phase.

TABLE 6

| | | | | S distribution % | | | | |
|---|---|---|---|---|---|---|---|---|
| Ex. | NaClO/ RSH | NaClO wt % | Mixing Type | RSO2Cl | RSSR | RSO2SR | Aqueous calculated | Aqueous measured |
| 17 | 6 | 1 | A | 13 | 48 | 4 | 33 | 24 |
| 18 | 6 | 1 | B | 5 | 34 | 4 | 56 | 55 |
| 19 | 3 | 1 | B | 14 | 24 | 4 | 61 | 60 |
| 20 | 6 | 5 | B | 9 | 0 | 0 | 91 | 98 |
| 21 | 4 | 5 | B | 19 | 0 | 2.6 | 78 | 83 |

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for selectively treating a crude oil feed containing mercaptans to remove mercaptans while retaining other non-mercaptan sulfur species, comprising:

contacting a crude oil feed containing mercaptans and non-mercaptan sulfur species with a treatment solution comprising a hypochlorite, wherein the crude oil feed is not a petroleum distillate, wherein the molar ratio of hypochlorite to mercaptans in the crude oil feed ranges from 1:1 to 10:1, whereby the hypochlorite oxidizes the mercaptans generating a treated crude oil having a reduced concentration of mercaptans of less than 50 ppm and a first concentration of chloride and a spent treatment solution containing at least a sulfur oxoacid or salt thereof, having the formula $[RSO_x]_nY$, wherein R is a hydrocarbyl group; x is an integer from 1 to 3; n is 1 or 2; and Y is hydrogen, an alkaline metal, or alkaline earth metal and wherein the majority of mercaptans are removed from the treated crude oil and the majority of non-mercaptan sulfur species remain in the treated crude oil;

recovering the spent treatment solution and the treated crude oil;

contacting the treated crude oil with a caustic solution at a molar ratio of caustic to organic chloride of 0.1:1 to 50:1, generating a spent alkaline solution and an upgraded crude oil having a reduced concentration of mercaptan and a reduced concentration of organic chloride;

recovering the spent alkaline solution and the upgraded crude oil having a reduced concentration of mercaptan and a reduced concentration of organic chloride of less than 10 ppm by weight.

2. The method of claim 1, further comprising treating the spent treatment solution via at least one of filtration and ion exchange to generate a first brine solution containing at least 99 wt. % as NaCl and water.

3. The method of claim 2, further comprising regenerating the first brine solution to form a regenerated hypochlorite stream.

4. The method of claim 3, further comprising routing the regenerated hypochlorite stream for use in the treatment solution.

5. The method of claim 3, wherein the first brine solution is regenerated by electrolyzing in an electrolyzer cell to form the regenerated hypochlorite stream.

6. The method of claim 2, further comprising removing at least 20% of water from the first brine solution to produce a second brine solution and electrolyzing the second brine solution in an electrolyzer cell.

7. The method of claim 3, further comprising adding a second brine solution to the electrolyzer cell to form the regenerated hypochlorite stream for use in the treatment solution.

8. The method of claim 1, wherein the crude oil feed is contacted with a treatment solution comprising sodium hypochlorite having a concentration ranging from 1 to 15% by weight.

9. The method of claim 1, wherein the treated crude oil is contacted with a caustic solution comprising sodium hydroxide having a concentration of sodium hydroxide ranging from 0.001N to 10N.

10. The method of claim 1, wherein the crude oil feed is contacted with the treatment solution in a contact zone comprising at least one of a packed tower, a bubble tray column, a stirred mixing tank, a fiber contactor, and a rotating disc contactor.

11. The method of claim 1, wherein the crude oil feed is contacted with a treatment solution comprising a regenerated hypochlorite stream obtained from a hypochlorite regeneration unit.

12. The method of claim 1, wherein the crude oil feed is contacted with the treatment solution in a contact zone comprising fibers and wherein the contact of the crude oil feed with the treatment solution forms an admixture that flows over and along the fibers.

13. The method of claim 1, wherein the treated crude oil is recovered in a separation zone comprising fibers, and wherein the spent treatment solution and the treated crude oil form an admixture that flows over and along the fibers to form two liquid layers, a lower layer comprising the spent treatment solution and an upper layer comprising the treated crude oil.

14. The method of claim 1, wherein the treated crude oil is contacted with the caustic solution in a contact zone comprising fibers and wherein the contact of the treated crude oil with the caustic solution forms an admixture that flows over and along the fibers.

15. The method of claim 1, wherein the upgraded crude oil is recovered in a separation zone comprising fibers, and wherein the spent alkaline solution and the upgraded crude oil form an admixture that flows over and along the fibers to form two liquid layers, a lower layer comprising the spent alkaline solution and an upper layer comprising the upgraded crude oil.

16. A method for selectively treating a crude oil containing mercaptans while retaining other non-mercaptan sulfur species in the crude oil feed, comprising:

combining a sodium hypochlorite solution with a least a base to form a treatment solution having a pre-select pH;

contacting a crude oil feed which is not a petroleum distillate with the treatment solution comprising the sodium hypochlorite at a pre-select pH under intimate contact conditions sufficient for the hypochlorite to oxidize the mercaptans generating a treated crude oil having a reduced concentration of mercaptans of less than 50 ppm by weight and a first concentration of chloride and a spent treatment solution and wherein the majority of mercaptans are removed by the treated crude oil and the majority of non-mercaptan sulfur species remain in the treated crude oil;

recovering the spent treatment solution and the treated crude oil;

separating the spent treatment solution and the treated crude oil to recover the spent treatment solution and the treated crude oil as separate streams;

contacting the treated crude oil stream with a caustic solution under mixing conditions sufficient to generate a spent alkaline solution and an upgraded crude oil having less than 50 ppm by weight, mercaptan and less than 10 ppm by weight organic chloride;

separating the spent alkaline solution and the upgraded crude oil;

treating the spent treatment solution to generate a brine solution comprising at least 99 wt. % as sodium chloride in solution;

regenerating the brine solution to form a hypochlorite stream for use in the treatment solution.

17. The method of claim 16, wherein the crude oil and the treatment solution are intimately contacted by a contacting method selected from non-dispersive and dispersive contacting methods.

18. The method of claim 17, wherein the non-dispersive contacting method is selected from packed inert particle beds and fiber film contactors.

19. The method of claim 16, wherein the treated crude oil stream and the caustic solution are intimately contacted by a contacting method selected from non-dispersive and dispersive contacting methods.

* * * * *